US010744767B2

(12) United States Patent
Mizuno et al.

(10) Patent No.: US 10,744,767 B2
(45) Date of Patent: Aug. 18, 2020

(54) LIQUID EJECTION DEVICE

(71) Applicant: BROTHER KOGYO KABUSHIKI KAISHA, Nagoya-shi, Aichi-ken (JP)

(72) Inventors: Taisuke Mizuno, Nagoya (JP); Yasuo Kato, Aichi-ken (JP); Takashi Aiba, Nagoya (JP); Keita Sugiura, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/113,526

(22) Filed: Aug. 27, 2018

(65) Prior Publication Data

US 2018/0361743 A1 Dec. 20, 2018

Related U.S. Application Data

(62) Division of application No. 15/259,506, filed on Sep. 8, 2016, now Pat. No. 10,071,553.

(30) Foreign Application Priority Data

Sep. 8, 2015 (JP) ..... 2015-176295

(51) Int. Cl.

| | |
|---|---|
| ***B41J 2/14*** | (2006.01) |
| ***B41J 2/175*** | (2006.01) |
| ***B41J 2/055*** | (2006.01) |

(52) U.S. Cl.

CPC ..... *B41J 2/14233* (2013.01); *B41J 2/055* (2013.01); *B41J 2/175* (2013.01); *B41J 2/17556* (2013.01);

(Continued)

(58) Field of Classification Search

CPC ..... B41J 2/14233; B41J 2/055; B41J 2/175; B41J 2/17556; B41J 2002/14491; B41J 2002/14419

See application file for complete search history.

(56) References Cited

U.S. PATENT DOCUMENTS

2009/0102907 A1 4/2009 Yamanaka et al.
2009/0267988 A1 10/2009 Matsui et al.

(Continued)

FOREIGN PATENT DOCUMENTS

EP 0 774 356 A2 5/1997
JP H09-136415 A 5/1997

(Continued)

OTHER PUBLICATIONS

Machine translation of JP 2008-201024 A. (Year: 2008).*

(Continued)

*Primary Examiner* — Justin Seo

(74) *Attorney, Agent, or Firm* — Scully Scott Murhpy and Presser

(57) ABSTRACT

A liquid ejection device is disclosed. One device includes a liquid supply member defining a liquid supply channel that is in communication with a common liquid chamber via an outlet of the liquid supply channel. The outlet and the common liquid chamber extend along a longitudinal direction respectively. The liquid supply member includes a plurality of ribs located within the liquid supply channel, the plurality of ribs are disposed side by side in the longitudinal direction. The plurality of ribs includes a first rib, a second rib and a third rib. A distance from the first rib to the third rib in the longitudinal direction is smaller than a distance from the first rib to the second rib in the longitudinal direction.

3 Claims, 7 Drawing Sheets

(52) U.S. Cl.
CPC ..... *B41J 2002/14419* (2013.01); *B41J 2002/14491* (2013.01)

(56) References Cited

U.S. PATENT DOCUMENTS

| | | | | |
|---|---|---|---|---|
| 2011/0304678 | A1 | 12/2011 | Yamamoto | |
| 2015/0174897 | A1* | 6/2015 | Arimoto | B41J 2/04541 347/6 |
| 2015/0343781 | A1 | 12/2015 | Hamada et al. | |

FOREIGN PATENT DOCUMENTS

| | | | |
|---|---|---|---|
| JP | H11-70667 | A | 3/1999 |
| JP | 2006-212781 | A | 8/2006 |
| JP | 2007-313761 | A | 12/2007 |
| JP | 2008-201024 | A | 9/2008 |
| JP | 2009-262360 | A | 11/2009 |
| JP | 2010-188547 | A | 9/2010 |
| JP | 2012-000799 | A | 1/2012 |
| JP | 2014-58167 | A | 4/2014 |

OTHER PUBLICATIONS

United States Notice of Allowance dated May 7, 2018 received in related U.S. Appl. No. 15/259,506.
Official Action dated May 21, 2019 received from the Japanese Patent Office in related application JP 2015-176295 together with an English language translation.

* cited by examiner

LIQUID EJECTION DEVICE

CROSS-REFERENCE TO RELATED APPLICATION

This application is a divisional application of U.S. Ser. No. 15/259,506 filed on Sep. 8, 2016 and claims priority from Japanese Patent Application No. 2015-176295, filed on Sep. 8, 2015, which is incorporated herein by reference in its entirety.

TECHNICAL FIELD

The disclosure relates to a liquid ejection device for ejecting liquid from nozzles.

BACKGROUND

A known liquid ejection device includes a channel-defining substrate and a case member. The channel-defining substrate has a plurality of pressure chambers arranged along a nozzle-row extending direction. The case member has a manifold extending along the nozzle-row extending direction.

SUMMARY

In the manifold of the known liquid ejection device, while an ink flow speed increases at a central portion of the manifold in the lengthwise direction, the ink flow speed may decrease at end portions of the manifold in the lengthwise direction. Therefore, an ink supply amount may vary among nozzles, and thus refill performance may vary among the nozzles.

Accordingly, some embodiments of the disclosure provide for a liquid ejection device in which liquid supply variation among nozzles may be surely reduced.

According to one aspect of the disclosure, a liquid ejection device includes a liquid supply member defining a liquid supply channel that is in communication with a common liquid chamber via an outlet of the liquid supply channel. The outlet and the common liquid chamber extend along a longitudinal direction respectively. The liquid supply member includes a plurality of ribs located within the liquid supply channel. The plurality of ribs are disposed side by side in the longitudinal direction. The plurality of ribs includes a first rib, a second rib and a third rib. The second rib is disposed in a first direction of the first rib. The first direction is in the longitudinal direction. The second rib is adjacent to the first rib. The third rib and an inlet of the liquid supply channel are disposed in a second direction of the first rib. The second direction is in the longitudinal direction and opposite to first direction. The third rib is adjacent to the first rib. A distance from the first rib to the third rib in the longitudinal direction is smaller than a distance from the first rib to the second rib in the longitudinal direction.

According to one aspect of the disclosure, liquid supply variation in the common liquid chamber with respect to the first direction may be reduced. Further, pressure fluctuation in the common liquid chamber that may be caused by excessive increase of a liquid flow speed at the central portion (e.g., a portion close to a supply channel) of the common liquid chamber may be reduced.

According to further aspect of the disclosure, a liquid ejection device is disclosed. The liquid ejection device includes a liquid supply member defining a liquid supply channel that is in communication with a common liquid chamber via an outlet of the liquid supply channel. The outlet and the common liquid chamber extends along a longitudinal direction respectively. The outlet is divided into a plurality of sub-outlets in the longitudinal direction. The plurality of sub-outlets includes a first sub-outlet and a second sub-outlet. The first sub-outlet is adjacent to the second sub-outlet. A distance from an inlet of the liquid supply channel to the first sub-outlet in the longitudinal direction is smaller than a distance from the inlet to the second sub-outlet in the longitudinal direction. A length of the first sub-outlet in the longitudinal direction is smaller than a length of the second sub-outlet in the longitudinal direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
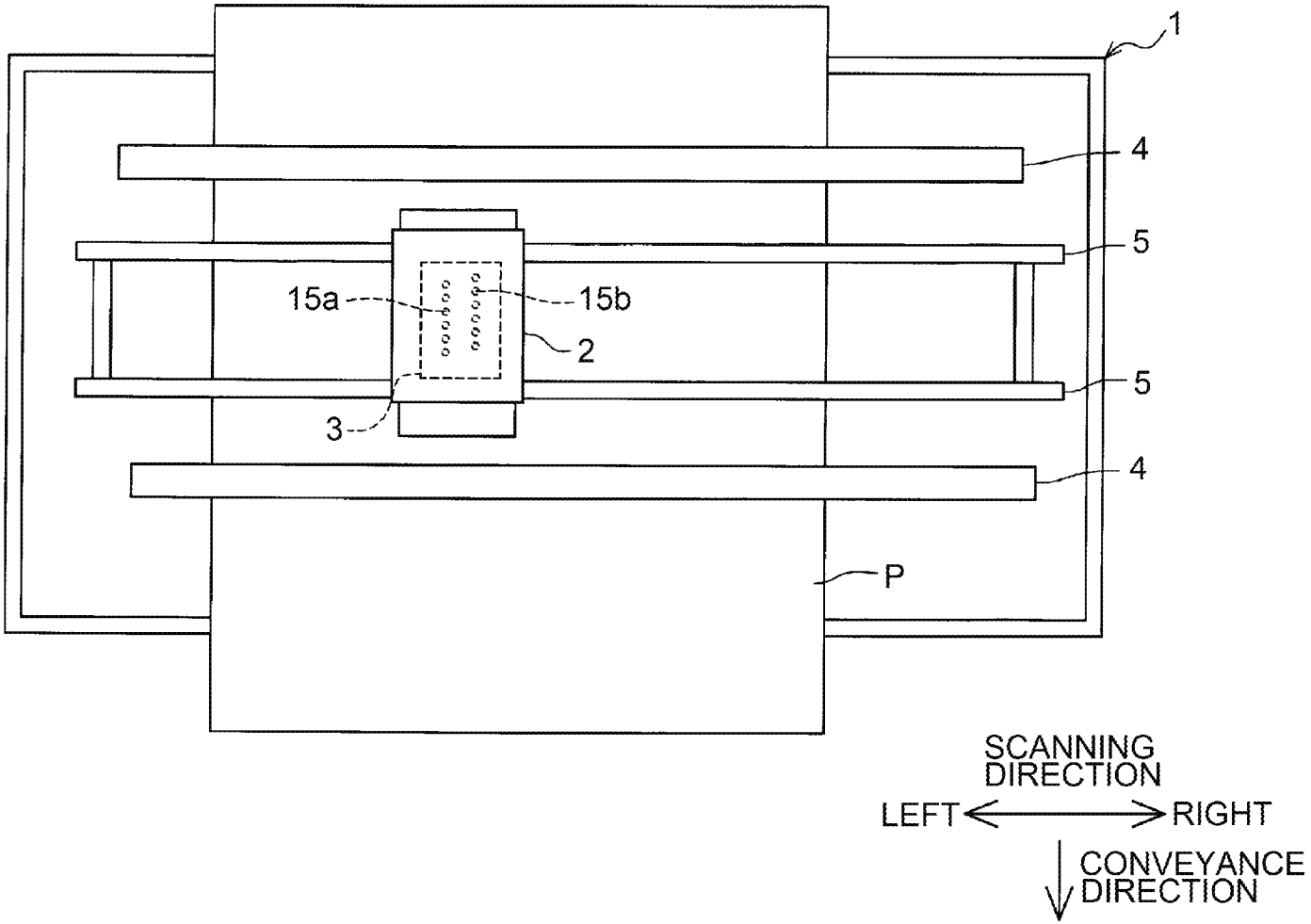
FIG. 1 is a schematic diagram depicting a printer in an illustrative embodiment according to one or more aspects of the disclosure.

Hereinafter, an illustrative embodiment will be described in detail with reference to the accompanying drawing, like reference numerals being used for like corresponding parts in the various drawings. Common elements will be indicated by common numbers or letters without distinguishing letters or numbers when not distinguishing therebetween.

(Overall Configuration of Printer)

As depicted in FIG. 1, a printer 1 according to the illustrative embodiment includes a carriage 2, an inkjet head 3, and sheet conveyor rollers 4. The carriage 2 is supported by a plurality of, for example, two, guide rails 5 and reciprocates in a scanning direction (as an example of a third direction) along the guide rails 5. The inkjet head 3 is mounted on the carriage 2, and has a plurality of nozzles 15*a* and 15*b* in a lower surface thereof. The sheet conveyor rollers 4 are disposed on opposite sides of the carriage 2 with respect to a conveyance direction. The sheet conveyor rollers 4 convey a recording sheet P along the conveyance direction (as an example of a first direction). The conveyance direction may be a direction orthogonal to the scanning direction. As depicted in FIG. 1, the scanning direction may be bidirectional and one of the scanning direction may be defined as right and the other of the scanning direction maybe defined as left.

Upon receipt of a print instruction, the printer 1 starts conveying a recording sheet P and reciprocating the carriage 2 in synchronization with the sheet conveyance. In accordance with this, the printer 1 drives the inkjet head 3 to eject ink from the nozzles 15*a* and 15*b*, thereby forming an image based on image data on the recording sheet P.

(Inkjet Head)

Figure 2:
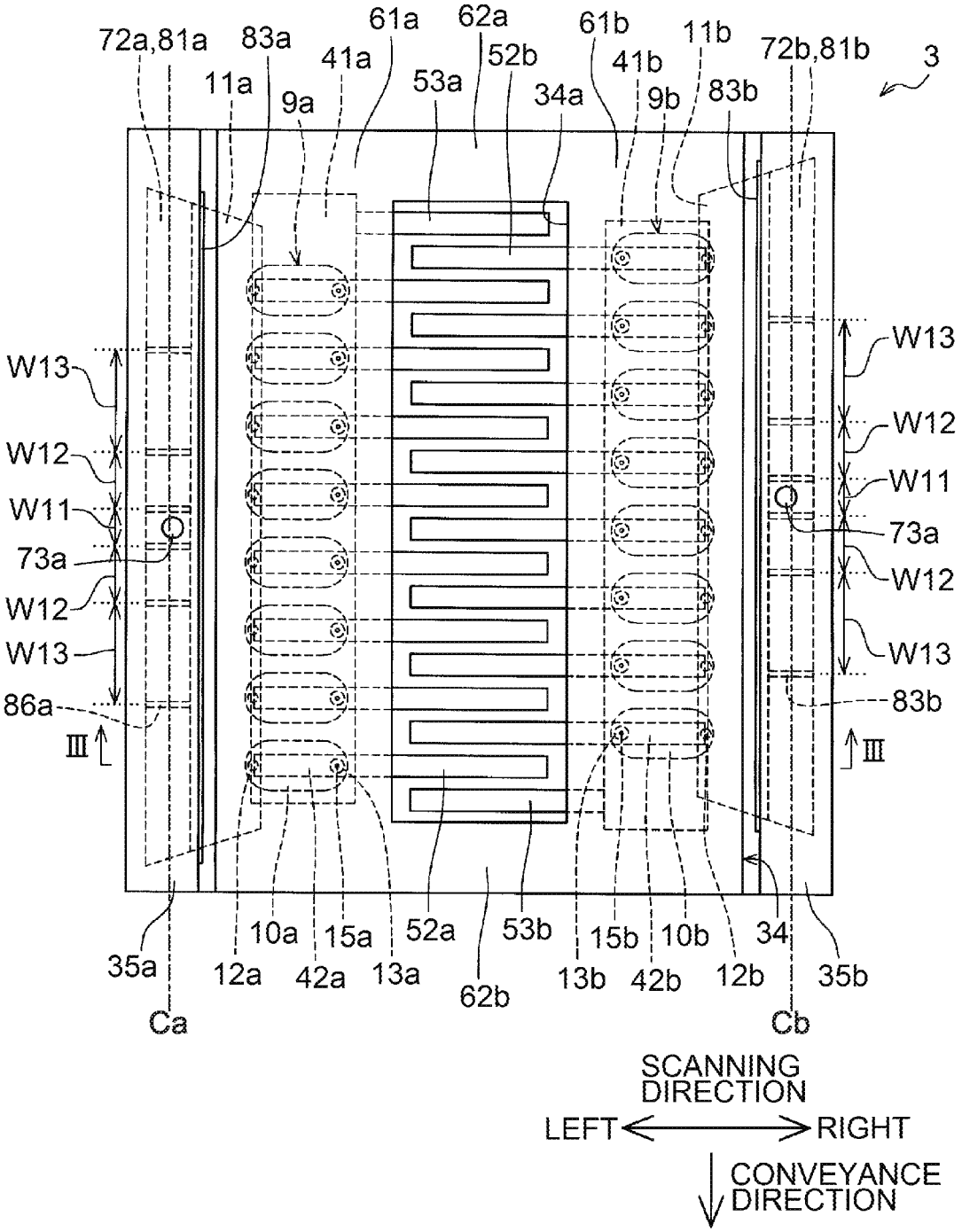
FIG. 2 is a plan view depicting an inkjet head in the illustrative embodiment according to one or more aspects of the disclosure.
Figure 3:
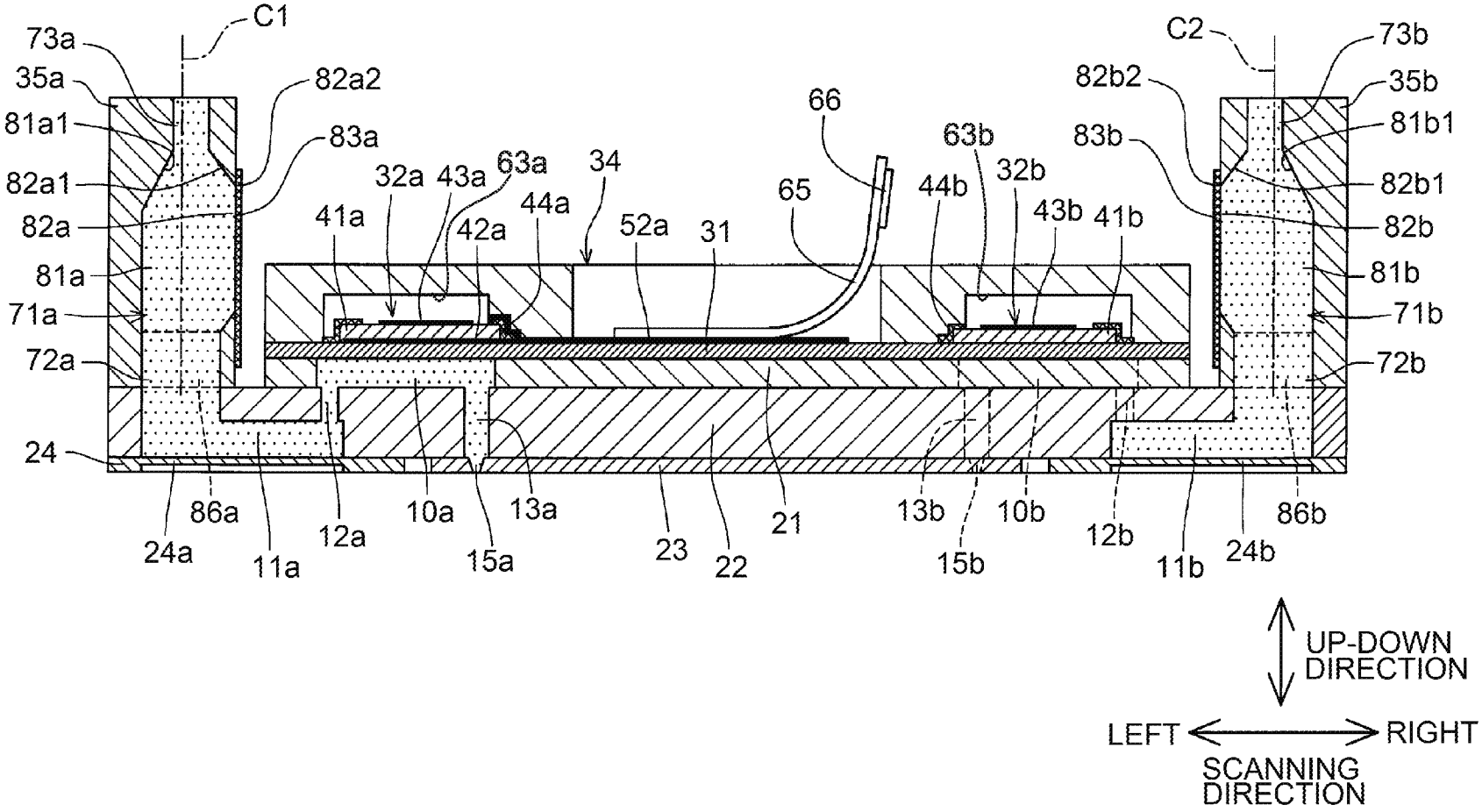
FIG. 3 is a sectional view taken along line III-III in FIG. 2 in the illustrative embodiment according to one or more aspects of the disclosure.

The inkjet head 3 will be described in detail. As depicted in FIGS. 2 and 3, the inkjet head 3 includes a pressure chamber plate 21, a manifold plate 22, a nozzle plate 23, a cover plate 24, a vibration film 31, piezoelectric actuators 32*a* and 32*b*, a support plate 34, and ink supply members 35*a* and 35*b*.

The pressure chamber plate 21 may be made of, for example, silicon (Si), and has a plurality of through holes. The through holes have an oval shape at their ends and are elongated in the scanning direction. The ends of each through hole are closed by the vibration film 31 and the manifold plate 22, respectively, from above and below. This configuration provides a plurality of pressure chambers 10*a* and 10*b*. The pressure chambers 10*a* are aligned along the conveyance direction and constitute a pressure chamber row 9*a*. The pressure chambers 10*b* are aligned along the conveyance direction and constitute a pressure chamber row 9*b*. The pressure chambers 10*a* and 10*b* are arranged in a staggered manner throughout while equally spaced from each other in the respective pressure chamber rows 9*a* and 9*b* with respect to the conveyance direction. That is, each of the left pressure chambers 10*a* is positioned downstream of a corresponding one of the right pressure chambers 10*b* with respect to the conveyance direction by a half of a distance between adjacent pressure chambers 10 in the same one of the pressure chamber rows 9*a* and 9*b*.

The manifold plate 22 is joined to a lower surface of the pressure chamber plate 21. The manifold plate 22 is longer in length in the scanning direction than the pressure chamber plate 21 and both end portions of the manifold plate 22 protrude relative to respective ends of the pressure chamber plate 21 in the scanning direction. The manifold plate 22 may be made of, for example, silicon (Si). The manifold plate 22 has a plurality of, for example, two, manifold channels 11*a* and 11*b* (as an example of a common liquid chamber), a plurality of throttle channels 12*a* and 12*b*, and a plurality of descender channels 13*a* and 13*b*.

The manifold channel 11*a* is defined in a left portion of the manifold plate 22 in the scanning direction and occupies a lower half portion of the manifold plate 22. The manifold channel 11 opens a portion of a lower surface of the manifold plate 22. The manifold channel 11*a* extends over the pressure chamber row 9*a* along the conveyance direction, and also extends astride a left end of the pressure chamber plate 21 along the scanning direction. The manifold channel 11*a* partially coincide with the throttle channels 12*a* at its right end portion when viewed from above or below in an up-down direction (as an example of a second direction). The manifold channel 11*a* has a left end portion, which extends upward and opens a portion of an upper surface of the manifold plate 22.

The manifold channel 11*a* and the manifold channel 11*b* are symmetric with respect to a central portion of the manifold plate 22 in the scanning direction. That is, the manifold channel 11*b* extends over the pressure chamber row 9*b* along the conveyance direction, and also extends astride a right end of the pressure chamber plate 21 along the scanning direction. The manifold channel 11*b* partially coincides with the throttle channels 12*b* at its left end portion when viewed from above or below in the up-down direction. The manifold channel 11*b* has a right end portion, which extends upward and opens another portion of the upper surface of the manifold plate 22.

The throttle channels 12*a* are defined in the left portion of the manifold plate 22 in the scanning direction and occupy an upper half portion of the manifold plate 22. Each of the throttle channels 12*a* extends in the up-down direction. Each of the throttle channels 12*a* has an upper end that is connected with a left end portion of a corresponding one of the pressure chambers 10*a*, and a lower end that is connected with the manifold channel 11*a*. The throttle channels 12*b* are defined in the right portion of the manifold plate 22 in the scanning direction and occupy the upper half portion of the manifold plate 22. Each of the throttle channels 12*b* connects between a right end portion of a corresponding one of the pressure chambers 10*b* and the manifold channel 11*b*. That is, the throttle channels 12 correspond one-to-one to the pressure chambers 10. The throttle channels 12*a* and 12*b* are arranged in a staggered manner throughout while equally spaced from each other in each row with respect to the conveyance direction.

The descender channels 13*a* are defined in the left portion of the manifold plate 22 in the scanning direction and may be through holes penetrating the manifold plate 22. Each of the descender channels 13*a* has an upper end that is connected with a right end portion of a corresponding one of the pressure chambers 10*a*, and a lower end that is connected with a corresponding one of the nozzles 15*a*. Each of the descender channels 13*b* connects between a left end portion of a corresponding one of the pressure chambers 10*b* and a corresponding one of the nozzles 15*b* in the left end portion of the manifold plate 22 in the scanning direction. That is, the descender channels 13 correspond one-to-one to the pressure chambers 10. The descender channels 13*a* and 13*b* are arranged in a staggered manner throughout while equally spaced from each other in each row with respect to the conveyance direction.

The nozzle plate 23 may be made of, for example, synthetic resin material. The nozzle plate 23 is joined to a central portion of the lower surface of the manifold plate 22. The nozzle plate 23 has the plurality of nozzles 15*a* and 15*b*. The nozzles 15 correspond to one-to-one to the descender channels 13. Each of the nozzles 15*a* and 15*b* is tapered towards its ejection opening. In light of uniformity of shape and size between the nozzles, in other embodiments, for example, the nozzle plate 23 may be made of silicon.

As described above, one of throttle channels 12, one of descender channels 13, and one of nozzles 15 are in communication with one of pressure chamber 10, which defines one of individual ink channels extending from a termination of one of the manifold channels 11. Therefore, a plurality of individual ink channels are defined in the right and left portions of the inkjet head 3 with respect to the central portion of the inkjet head 3. The right and left individual ink channels are symmetrically positioned with respect to the central portion of the inkjet head 3 in the conveyance direction irrespective of the staggered arrangement in the conveying direction.

The cover plate 24 may be made of, for example, metallic material. The cover plate 24 is joined to the lower surface of the manifold plate 22 and surrounds the nozzle plate 23. The cover plate 24 closes the lower openings of the manifold channels 11*a* and 11*b*. The cover plate 24 includes particular portions 24*a* and 24*b*, which coincide with the respective manifold channels 11*a* and 11*b* and have flexibility. Each of the portions 24*a* and 24*b* may be a recessed portion formed by half-etching the cover plate 24. The portions 24*a* and 24*b* each have a thin portion functioning as a damper film. The portions 24*a* and 24*b* are deformable due to ink pressure so as to reduce pressure fluctuation occurring in the respective manifold channels 11*a* and 11*b*. Nevertheless, in other embodiments, for example, the cover plate 24 may be made of flexible material, e.g., synthetic resin. In this case, the cover plate 24 might not require to have half-etching therein.

The vibration film 31 may be made of insulating material, e.g., zirconia ($ZrO_2$), alumina ($Al_2O_3$), silicon oxide ($SiO_2$), or silicon nitride ($Si_3N_4$). The vibration film 31 is disposed on an upper surface of the pressure chamber plate 21. The vibration film 31 closes the upper ends of all of the pressure chambers 10*a* and 10*b*. In the illustrative embodiment, the vibration film 31 covers an upper surface of the pressure chamber plate 21 entirely. In the illustrative embodiment, as depicted in FIG. 3, the vibration film 31 consists of a single layer. Nevertheless, in other embodiments, for example, the vibration film 31 may consist of multiple layers made of various materials.

The piezoelectric actuator 32*a* includes a piezoelectric layer 41*a*, a plurality of individual electrodes 42*a*, a common electrode 43*a*, and a protective film 44*a*. The plurality of individual electrodes 42*a*, the piezoelectric layer 41*a*, and the common electrode 43*a* are laminated on one another in this order from below above the vibration film 31. The piezoelectric actuator 32*a* includes a plurality of piezoelectric elements equal to the number of the individual electrodes 42*a*. Each of the piezoelectric elements has a laminated structure including a single individual electrode 42*a*, a corresponding portion of the piezoelectric layer 41*a*, and a corresponding portion of the common electrode 43*a*.

The individual electrodes 42*a* may be made of conductive material, e.g., platinum (Pt). The individual electrodes 42*a* are provided in one-to-one correspondence with the pressure chambers 10*a*. The individual electrodes 42*a* have a strip-like shape or a rectangular shape. A principal portion of each of the individual electrodes 42*a* overlaps a central portion of a corresponding one of the pressure chambers 10*a*.

The piezoelectric layer 41*a* may be made of, for example, piezoelectric material. In the illustrative embodiment, the piezoelectric layer 41*a* includes lead zirconate titanate mainly. The piezoelectric layer 41*a* has a band-like shape and extends continuously along the conveyance direction. While the piezoelectric layer 41*a* overlays on all of the individual electrodes 42*a* above the vibration film 31 in the conveyance direction, the piezoelectric layer 41*a* allows a right end portion of each of the individual electrodes 42*a* to be exposed. Nevertheless, in other embodiments, for example, a plurality of piezoelectric layers 41*a* may be provided in one-to-one correspondence with the pressure chambers 10*a*. In still other embodiments, for example, while the piezoelectric layer 41*a* has a band-like shape similar to the illustrative embodiment, the piezoelectric layer 41*a* may have slits between portions corresponding to the pressure chambers 10*a*. In these cases, the protective film 44*a* may be disposed covering an edge of each of the pressure chambers 10*a* in plan view.

The common electrode 43*a* may be made of conductive material, e.g., iridium (Ir). The common electrode 43*a* is laid on the piezoelectric layer 41*a* and extends along the piezoelectric layer 41*a*. The common electrode 43*a* has a band-like shape and extends over the pressure chamber row 9*a* along the conveyance direction. The piezoelectric layer 41*a* has particular portions, each of which is sandwiched between a corresponding portion of the common electrode 43*a* and one of the individual electrodes 42*a*. Each of the particular portions of the piezoelectric layer 41*a* functions as a deformable section (i.e., an active portion) in each of the piezoelectric elements. Each of the individual electrodes 42*a* includes an active portion. In the illustrative embodiment, each active portion is polarized in a direction from a corresponding individual electrode towards the common electrode (hereinafter, referred to as a "polarization direction").

The protective film 44*a* may be made of insulating material, e.g., silicon dioxide ($SiO_2$) or alumina ($Al_2O_3$). The protective film 44*a* covers end portions of the piezoelectric layer 41*a* having a band-like shape as well as portions of the vibration film 31 neighboring to the piezoelectric layer 41*a*. In particular, the protective film 44*a* covers the right end portion of the piezoelectric layer 41*a* while allowing the right end portion of each of the individual electrodes 42*a* to be exposed. The protective film 44*a* reduces or prevents the end portions of the piezoelectric layer 41*a* and the individual electrodes 42*a* from being damaged even when the piezoelectric elements are driven.

As voltage is applied between the common electrode 43*a* and one of the individual electrodes 42*a*, a corresponding active portion deforms independently. The active portion expands in a thickness direction parallel to the polarization direction and contracts in a surface extending direction orthogonal to the polarization direction. The piezoelectric actuator 32*a* includes such piezoelectric elements equal to the number of the individual electrodes 42*a*. As voltage is applied between the common electrode 43*a* and one of the individual electrodes 42*a*, a corresponding piezoelectric element deforms to protrude towards a corresponding pressure chamber 10 (e.g., unimorph deformation) in cooperation with the vibration film 31. That is, a single piezoelectric element and a portion of the vibration film 31 corresponding to the piezoelectric element constitute a single actuator (i.e., a unit actuator), and changes volume of a corresponding one of the pressure chambers 10*a* and 10*b*.

The piezoelectric actuator 32*b* includes a piezoelectric layer 41*b*, a plurality of individual electrodes 42*b*, a common electrode 43*b*, and a protective layer 44*b*. While the piezoelectric actuator 32*b* has a different arrangement pattern of the piezoelectric elements from the piezoelectric actuator 32*a*, the piezoelectric actuator 32*b* includes the same elements as the piezoelectric actuator 32*a* and the piezoelectric layer 41*b* is polarized in the same manner as the piezoelectric layer 41*a* of the piezoelectric actuator 32*a*. The piezoelectric actuator 32*b* includes a plurality of piezoelectric elements equal to the number of the individual electrodes 42*b*.

In the piezoelectric actuators 32*a* and 32*b*, the arrangement pattern of the piezoelectric elements reflects the arrangement pattern of the pressure chambers 10. The piezoelectric elements have one-to-one positional correspondence with the pressure chambers 10. The piezoelectric elements are arranged in a staggered manner with respect to the conveyance direction and constitute two piezoelectric element rows. The each of the piezoelectric elements in one row is positioned downstream of a corresponding one of the piezoelectric elements in the other row with respect to the conveyance direction, and the piezoelectric elements are arranged based on the arrangement pattern of the pressure chambers 10. The piezoelectric elements in one row and the piezoelectric elements in the other row are symmetrically positioned with respect to an intermediate area between the piezoelectric element rows irrespective of the staggered arrangement in the conveying direction.

A plurality of individual lead wires 52*a* and 52*b* and common lead wires 53*a* and 53*b* are disposed at the intermediate area between the piezoelectric element rows (e.g., at an intermediate area between the piezoelectric actuators 32*a* and 32*b*) in the scanning direction.

The individual lead wires 52 are provided in one-to-one correspondence with the individual electrodes 42 and may be made of conductive material, e.g., gold (Au) or aluminum (Al). Each of the individual lead wires 52*a* has a left end located on the protective film 44*a*, a central portion that is connected with a right end portion (e.g., an exposed portion not covered by the protective film 44*a*) of a corresponding one of the individual electrodes 42*a*, and a right end located adjacent to the piezoelectric actuator 32*b*. The individual lead wires 52*b* each have a configuration symmetrical to that of the individual lead wires 52*a* in the scanning direction irrespective of their positions in the conveyance direction. In the illustrative embodiment, the individual lead wires 52*a* and 52*b* extend along the scanning direction and are disposed alternately with respect to the conveyance direction.

The common lead wires 53*a* and 53*b* may be made of the same conductive material used for the individual lead wires 52*a* and 52*b*. The common lead wires 53*a* and 53*b* are disposed adjacent to respective opposite ends of a wire row consisting of the individual lead wires 52*a* and 52*b* in the conveyance direction. The common lead wire 53*a* is disposed upstream of the wire row in the conveyance direction and the common lead wire 53*b* is disposed downstream of the wire row in the conveyance direction. The common lead wire 53*a* has a left end that is connected with the common electrode 43*a* and a right end located adjacent to the piezoelectric actuator 32*b* with respect to the scanning direction. The common lead wire 53*b* has a right end that is connected with the common electrode 43*b* and a left end located adjacent to the piezoelectric actuator 32*a*. While the common lead wires 53*a* and 53*b* are located separately from each other with respect to the conveyance direction, the common lead wires 53*a* and 53*b* are symmetrically configured to each other with respect to the intermediate area between the piezoelectric element rows in the scanning direction. As described above, the individual lead wires 52 and the common lead wires 53 are concentrated on the intermediate area between the piezoelectric element rows, and therefore, a chip-on-film or chip-on-flex ("COF") 65 is connected to the intermediate area where the lead wires 52 and 53 are concentrated.

The COF 65 may be a plate-shaped flexible member including signal wirings. The COF 65 further includes a driver IC 66 mounted on a central portion thereof. The COF 65 has one end portion that is connected with the lead wires 52*a*, 52*b*, 53*a*, and 53*b* at the intermediate area between the piezoelectric element rows. The COF 65 has the other end portion that extends upward and is connected with a circuit board. At the time of driving the piezoelectric elements, the circuit board outputs image data. The driver IC 66 generates a driving signal based on the image data. The driving signal is supplied to each of the piezoelectric elements via a corresponding one of the individual lead wires 52*a* and 52*b*. The driving signal may be a pulse signal, which may be a combination of a ground potential and a driving potential (e.g., 20V). The common lead wires 53*a* and 53*b* are applied with the ground potential at all times.

(Method for Driving Inkjet Head)

A description will be made on how to eject ink from the nozzles 15 in the inkjet head 3. In the inkjet head 3, while the inkjet head 3 is not driven (e.g., while the inkjet head 3 is in a standby state), all of the individual electrodes 42*a* and 42*b* are kept at the ground potential.

For ejecting ink from a particular nozzle 15, a potential of an individual electrode 42 corresponding to the nozzle 15 is changed from the ground potential to the driving potential. When the potential of the individual electrode 42 becomes higher than the potential of the common electrode 43, an electric field that is directed towards the common electrode 43 from the individual electrode 42 occurs at a corresponding active portion of the piezoelectric layer 41. While the active portion contracts in the surface extending direction because the direction that the active portion is polarized is the same as the direction of the electric field, a corresponding portion of the vibration film 31 might not deform even when the electric field occurs. Thus, a difference is caused in deformation degree between the corresponding portion of the piezoelectric layer 41 and the corresponding portion of the vibration film 31, whereby a corresponding piezoelectric element deforms towards a corresponding pressure chamber 10. As the piezoelectric element deforms, ink in the pressure chamber 10 is pressurized, whereby some of ink is ejected from the nozzle 15. Thereafter, as the potential of the individual electrode 42 becomes the ground potential again, the piezoelectric element is restored and the volume of the pressure chamber 10 becomes the original volume that is the volume before the driving potential is applied. At that time, the pressure chamber 10 is refilled with ink supplied from the manifold channel 11, and thus preparation for the next ink ejection (e.g., preparation for the next application of the driving potential) is ready.

(Support Plate)

The support plate 34 may be made of, for example, silicon (Si). The support plate 34 is joined to the upper surface of the vibration film 31. The support plate 34 includes a plurality of, for example, two, pressure-chamber facing portions 61*a* and 61*b* and a plurality of, for example, two, connecting portions 62*a* and 62*b*. The connecting portion 62*a* connects between the pressure-chamber facing portions 61*a* and 61*b* at an upstream portion of the support plate 34 in the conveyance direction, and the connecting portion 62*b* connects between the pressure-chamber facing portions 61*a* and 61*b* at a downstream portion of the support plate 34 in the conveyance direction. The support plate 34 may be a rectangular frame. The support plate 34 and the pressure chamber plate 21 coincide with each other at their outer edges. The support plate 34 enhances rigidity of the inkjet head 3 and protects the piezoelectric actuators 32 from the outside. The support plate 34 has a central opening 34*a*. The vibration film 31 is partially exposed (e.g., a most portion of the intermediate area between the piezoelectric element rows is exposed) through the central opening 34*a*. The COF 65 protrudes relative to the support plate 34 through the central opening 34*a*. Nevertheless, in other embodiments, for example, in consideration of a stable electrical connection of the COF 65, the central opening 34*a* may be filled with an adhesive agent or a molding agent.

The pressure-chamber facing portion 61*a* constitutes a left portion of the support plate 34 in the scanning direction and faces the pressure chamber row 9*a* of the pressure chamber plate 21. The pressure-chamber facing portion 61*a* has a recessed portion 63*a* in its lower surface. The recessed portion 63*a* overlaps the pressure chamber row 9*a* in plan view, and accommodates all of the pressure chambers 10*a* therein. Therefore, a most portion of the piezoelectric actuator 32*a* is accommodated in a space defined by the recessed portion 63*a* and the vibration film 31.

The pressure-chamber facing portion 61*b* is symmetrically configured and positioned to the pressure-chamber facing portion 61*a* with respect to the central opening 34*a*.

The pressure-chamber facing portion 61*b* has a recessed portion 63*b* in its lower surface. A most portion of the piezoelectric actuator 32*b* is accommodated in a space defined by the recessed portion 63*b* and the vibration film 31.

(Ink Supply Members)

The ink supply members 35 may be made of, for example, synthetic resin material, and supply ink to the manifold plate 22. The ink supply members 35 are provided in one-to-one correspondence with the manifold channels 11. In the illustrative embodiment, the inkjet head 3 includes two ink supply members 35*a* and 35*b*, which are disposed at respective opposite end portions of the manifold plate 22 in the scanning direction. Each of the ink supply members 35*a* and 35*b* extends across the manifold plate 22 in the conveyance direction. Each of the ink supply members 35 includes a damper portion 71, a communication channel 72, and a supply channel 73. As depicted in FIG. 3, the ink supply members 35*a* and 35*b* are symmetrically configured and positioned with respect to the support member 34. Hereinafter, therefore, the left ink supply member 35*a* in the scanning direction will be described in detail as an example.

The ink supply member 35*a* includes a damper portion 71*a*. The damper portion 71*a* includes a damper chamber 81*a*, an opening 82*a*, and a damper film 83*a* (as an example of a damper film or a first damper film). The damper chamber 81*a* connects between a supply channel 73*a* and a communication channel 72*a* smoothly. The supply channel 73*a* is defined in an upper portion of the ink supply member 35*a*. The communication channel 72*a* is defined in a lower portion of the ink supply member 35. The damper chamber 81*a* includes a tapered upper portion having inclined surfaces. The tapered upper portion of the damper chamber 81*a* is contiguous to the supply channel 73*a* having a relatively small cross section. For example, as depicted in FIG. 3, the damper chamber 81*a* has a left inner-wall surface 81*a*1 whose upper portion is located further to the right than whose lower portion. The damper chamber 81*a* has a lower portion, which extends along the conveyance direction and coincides with the entire length of the communication channel 72*a* when viewed from above or below. With this configuration, the damper chamber 81*a* has a cross-sectional area extending orthogonal to the up-down direction, which decreases with its height.

The opening 82*a* is defined in a right sidewall of the damper portion 71*a* in the scanning direction and exposes the damper chamber 81*a* therethrough. The opening 82*a* is defined by an edge portion 82*a*1. The edge portion 82*a*1 is tapered such that the opening 82*a* has a cross-sectional area extending orthogonal to the scanning direction, which decreases with distance towards the right in the scanning direction (e.g., towards the outside).

The damper film 83*a* may be a flexible film-like member. The damper film 83*a* is adhered to an exterior surface of the sidewall having the opening 82*a* so as to cover the opening 82*a*. The damper film 83*a* defines the damper chamber 81*a*. The damper film 83*a* is configured to deform to reduce ink pressure fluctuation occurring in the damper chamber 81*a*.

The communication channel 72*a* is defined in the lower portion of the ink supply member 35*a* and connects between the damper chamber 81*a* and an upper opening of the manifold channel 11*a* smoothly. The communication channel 72*a* has a lower portion, which extends along the conveyance direction and coincides with the entire length of the opening of the manifold channel 11*a* when viewed from above or below.

In the communication channel 72*a*, a plurality of flow-adjusting ribs 86*a* are disposed side by side in the conveyance direction. The flow-adjusting ribs 86*a* are plates that makes the liquid supply amount uniform in the conveyance direction. A central portion of the communication channel 72*a* in the conveyance direction faces the supply channel 73*a*. Therefore, an interval between each adjacent two of the flow-adjusting ribs 86*a* increases with distance from the central portion of the communication channel 72*a* (e.g., interval W11<interval W12<interval W13 in FIG. 2). The interval between adjacent two of the flow-adjusting ribs 86*a* means an interval between centers of adjacent two of the ribs 86*a* in the scanning direction. These centers of flow-adjusting ribs 86*a* in the scanning direction intersect a center line Ca of the communication channel 72*a* in scanning direction. Each of the flow-adjusting ribs 86*a* connects between opposite inner-wall surfaces of the communication channel 72*a* in the scanning direction. With this configuration, the communication channel 72*a* is divided into several sections by the flow-adjusting ribs 86*a* with respect to the conveyance direction.

The flow-adjusting ribs 86*a* ensure uniform ink flow in the communication channel 72*a*. And the flow-adjusting ribs 86*a* support the right sidewall of the communication channel 72*a* from inside of the communication channel 72*a* against a film adhering direction at the time of adhering the damper film 83*a* to the right sidewall. That is, the flow-adjusting ribs 86*a* may serve as plates that makes resistance to liquid flow for making the liquid supply amount uniform in the conveyance direction. And the flow-adjusting ribs 86*a* may serve as structural reinforcing members.

As depicted in FIG. 2, the supply channel 73*a* may be a tubular hole. The supply channel 73*a* coincides with a central portion of the damper chamber 81*a* in the conveyance direction. The supply channel 73*a* has a lower end, which is positioned higher than an upper edge 82*a*2 defining the opening 82*a*. The supply channel 73*a* is positioned to the right of a center line C1 of the damper chamber 81*a* in the scanning direction. In other words, the supply channel 73*a* is positioned closer to the right sidewall of the damper portion 71*a* than a left sidewall of the damper portion 71*a* in the scanning direction. The supply channel 73*a* has an upper end, which is connected to an ink cartridge (not depicted) via, for example, a tube (not depicted).

The ink supply member 35*b* may be made of the same material used for the ink supply member 35*a*. The ink supply member 35*b* has a configuration symmetrical to that of the ink supply member 35*a* with respect to the support member 34. More specifically, for example, the ink supply member 35*b* includes a damper portion 71*b*, a communication channel 72*b*, and a supply channel 73*b*, each of which has a structural feature that is the same as a corresponding one of the portions of the ink supply member 35*a*. For example, the damper portion 71*b* includes a damper chamber 81*b*, an opening 82B, and an edge portion 82*b*1 and an upper edge 82*b*2 defining the opening 82B, which are disposed at respective corresponding positions to the positions of their correspondences in the damper portion 71*a* and have the same or similar configurations respectively to their correspondences in the damper portion 71*a*. A plurality of flow-adjusting ribs 86*b* are disposed in the communication channel 72*b* and has the same or similar configuration to the flow-adjusting ribs 86*a* disposed in the damper portion 71*a*. The supply channel 73*b* has the same or similar configuration to the supply channel 73*a* of the damper portion 71*a* and has the same or similar positional relationship with other portions to the positional relationship that the supply channel 73*a* of the damper portion 71*a* has. The interval between each adjacent two of the flow-adjusting ribs 86*b* increases with distance from the central portion of the communication channel 72*b* (e.g., interval W11<interval W12<interval W13 in FIG. 2). The interval between adjacent two of the flow-adjusting ribs 86*b* means an interval between centers of adjacent two of the flow-adjusting ribs 86*b* in the scanning direction. These centers of flow-adjusting ribs 86*b* in the scanning direction intersect a center line Cb of the communication channel 72*b* in scanning direction.

With this configuration, in each of the right and left portions of the inkjet head 3, ink supplied into the supply channel 73 from the outside of the inkjet head 3 spreads over the damper chamber 81 and flows into the manifold channel 11 via the communication channel 72. Meanwhile, when pressure fluctuation occurs in ink, the damper film 83 reduces and removes the pressure fluctuation. When an ink-flow speed distribution fluctuates, the flow-adjusting ribs 86 make the speed distribution uniform. Ink then further flows into individual ink channels from the manifold channel 11. In each of the individual ink channels, ink flows to the nozzle 15 through the throttle channel 12, the pressure chamber 10, and the descender channel 13. As a particular piezoelectric element is driven, a volume of a corresponding pressure chamber 10 changes, whereby an ink droplet is ejected from a corresponding nozzle 15.

In the illustrative embodiment, each of the ink supply members 35 changes a form of the ink flow channel as well as supplying ink. For example, each of the ink supply members 35 changes the form of the ink flow channel defined therein from one form (e.g., a tubular channel) to another form (e.g., a channel having an elongated slit-like shape in cross section (e.g., the manifold channel 11)). As ink in a pressure chamber 10 is consumed by driving of a particular piezoelectric element, the pressure chamber 10 is refilled with ink supplied from the tube by a negative pressure caused in the pressure chamber 10. In the ink supply member 35, ink flows towards the damper chamber 81 from the supply channel 73. In the damper chamber 81, ink flow may be controlled by the internal shape of the supply channel 73 depending on an ink refill amount. More specifically, for example, in each of the damper chamber 81 and the communication channel 72, a relatively large amount of ink flows at a location facing the supply channel 73 and the ink flow amount decreases with distance from the location facing the supply channel 73. In the damper chamber 81 and the communication channel 72, the ink flow amount has a distribution having a peak at their central portions in the conveyance direction and a less amount at their end portions in the conveyance direction. In the illustrative embodiment, the flow-adjusting ribs 86*a* and 86*b* are disposed in the respective communication channels 72*a* and 72*b*. The interval between each adjacent two of the flow-adjusting ribs 86*a* and the interval between each adjacent two of the flow-adjusting ribs 86*b* decrease with distance closer to the central portions of the communication channels 72*a* and 72*b*, respectively, in the conveyance direction. Since the flow-adjusting ribs 86*a* and 86*b* are resistances to ink flow, ink may get harder to flow at the central portions of the communication channels 72*a* and 72*b* than the end portions of the communication channels 72*a* and 72*b*. Accordingly, ink may be supplied equally to the entire portion of the manifold channels 11*a* and 11*b* from the respective communication channels 72*a* and 72*b* irrespective of locations.

In the illustrative embodiment, the damper portions 71*a* and 71*b* are located upstream of the respective manifold channels 11*a* and 11*b* in a direction in which ink flows (hereinafter, referred to as an "ink flow direction"). Therefore, pressure fluctuation of ink to be supplied to the manifold channels 11*a* and 11*b* may be reduced more effectively. In the illustrative embodiment, the ink supply members 35*a* and 35*b* are reinforced with the respective flow-adjusting ribs 86*a* and 86*b*. Therefore, damage on the ink supply members 35*a* and 35*b* may be avoided at the time of adhering the damper films 83*a* and 83*b* to the respective ink supply members 35*a* and 35*b*.

In the illustrative embodiment, the edge portion 82*a*1 of the opening 82*a* and the edge portion 82*b*1 of the opening 82*b* are tapered such that each of the openings 82*a* and 82*b* has a cross-sectional area extending orthogonal to the scanning direction, which decreases with distance towards the outside from a corresponding one of the damper chambers 81*a* and 81*b*. With this configuration, air bubbles may hardly stay at the edge portions 82*a*1 and 82*b*1 and their surroundings.

As ink is ejected from the nozzles 15*a* and 15*b* as described above, pressure in the damper chambers 81*a* and 81*b* decreases temporarily and the damper films 83*a* and 83*b* deform towards the inside of the damper chambers 81*a* and 81*b*, respectively. At that time, if however the lower ends of the supply channels 73*a* and 73*b* are located at the same height as the upper edges 82*a*2 and 82*b*2 of the openings 82*a* and 82*b*, respectively, the deformed damper films 83*a* and 83*b* may close the respective supply channels 73*a* and 73*b*, resulting in causing a shortage of ink supply.

As opposed to this, in the illustrative embodiment, the lower ends of the supply channels 73*a* and 73*b* are located higher than the upper edges 82*a*2 and 82*b*2 of the openings 82*a* and 82*b*, respectively. Therefore, a clearance is ensured between the damper film 83*a* and the supply channel 73*a* and between the damper film 83*b* and the supply channel 73*b*. With this configuration, the deformed damper films 83*a* and 83*b* might not close the respective supply channels 73*a* and 73*b*.

In the illustrative embodiment, the supply channels 73*a* and 73*b* are positioned closer to the respective openings 82*a* and 82*b* relative to the center lines C1 and C2 of the damper chambers 81*a* and 81*b*, respectively. Therefore, when the damper films 83*a* and 83*b* deform towards the inside of the damper chambers 81*a* and 81*b*, respectively, ink flowing into the damper chambers 81*a* and 81*b* may hit the respective damper films 83*a* and 83*b* easily. Accordingly, ink pressure fluctuation occurring in the damper chambers 81*a* and 81*b* may be reduced effectively.

Considering that ink flowing into the damper chambers 81*a* and 81*b* is made to reach the damper films 83*a* and 83*b* easily while the damper films 83*a* and 83*b* deform towards the inside of the respective damper chambers 81*a* and 81*b*, it may be preferable that the supply channels 73*a* and 73*b* are positioned closer to the openings 82*a* and 82*b*, respectively, in the scanning direction relative to the respective center lines C1 and C2 such that the supply channels 73*a* and 73*b* overlap the respective deformed damper films 83*a* and 83*b* when viewed from above or below.

In the illustrative embodiment, the upper portion of the left inner-wall surface 81*a*1 (e.g., the inner-wall surface opposite to the opening 82*a* of the damper chamber 81*a*) of the damper chamber 81*a* is located further to the right than the lower portion of the left inner-wall surface 81*a*1 and an upper portion of a right inner-wall surface 81*b*1 (e.g., the inner-wall surface opposite to the opening 82*b* of the damper chamber 81*b*) of the damper chamber 81*b* is located further to the left than the lower portion of the right inner-wall surface 81*b*1. Thus, each of the damper chambers 81*a* and 81*b* has a cross-sectional area extending orthogonal to the up-down direction, which decreases with its height. Therefore, air existing in the damper chambers 81*a* and 81*b* may move easily towards the supply channels 73*a* and 73*b* along the respective inclined inner-wall surfaces 81*a*1 and 81*b*1, whereby air may hardly stay in the damper chambers 81*a* and 81*b*. Accordingly, this configuration may reduce air flow into the individual ink channels.

In the illustrative embodiment, the damper films 83*a* and 83*b* are adhered to the respective sidewalls of the damper portion 71*a* (e.g., the right sidewall of the damper portion 71*a*) and the damper portion 71*b* (e.g., the left sidewall of the damper portion 71*b*) (i.e., the facing inner sidewalls of the damper portions 71*a* and 71*b*). Therefore, this configuration may reduce direct application of an exterior force to the damper films 83*a* and 83*b*. Accordingly, the damper films 83*a* and 83*b* may hardly be damaged during manufacture of the inkjet head 3.

In the illustrative embodiment, the lower walls defining the respective manifold channels 11*a* and 11*b* function as damper films for reducing pressure fluctuation when ink flows downward from the communication channels 72*a* and 72*b* to the respective manifold channels 11*a* and 11*b*. Ink flowing into the manifold channels 11*a* and 11*b* moves towards the lower walls functioning as the dampers and further moves along the lower walls. Therefore, ink pressure fluctuation occurring in the manifold channels 11*a* and 11*b* may be surely reduced.

Due to ink ejection, unnecessary vibration may remain in the manifold channels 11*a* and 11*b*. Even when such vibration occurs, the lower walls functioning as the damper films (e.g., the portions 24*a* and 24*b*) may reduce the vibration effectively, whereby liquid crosstalk between adjacent pressure chambers 10 and breakage of meniscus of ink may be reduced or prevented.

While the disclosure has been described in detail with reference to the specific embodiment thereof, this is merely an example, and various changes, arrangements and modifications may be applied therein without departing from the spirit and scope of the disclosure.

In the illustrative embodiment, the ink supply members 35*a* and 35*b* are provided independently and the openings 82*a* and 82*b* are defined in the facing inner sidewalls of the damper portions 71*a* and 71*b* in the scanning direction. Nevertheless, the configurations of the ink supply members 35*a* and 35*b* are not limited to the specific example. For example, in a first variation, as depicted in FIGS. 4 and 5, an inkjet head 3 includes a single ink supply member 101 and has a plurality of, for example, two, openings 104*a* and 104*b* at the other sidewalls of the damper portions 71*a* and 71*b*, which might not face each other in the scanning direction (i.e., outer sidewalls).

Figure 4:
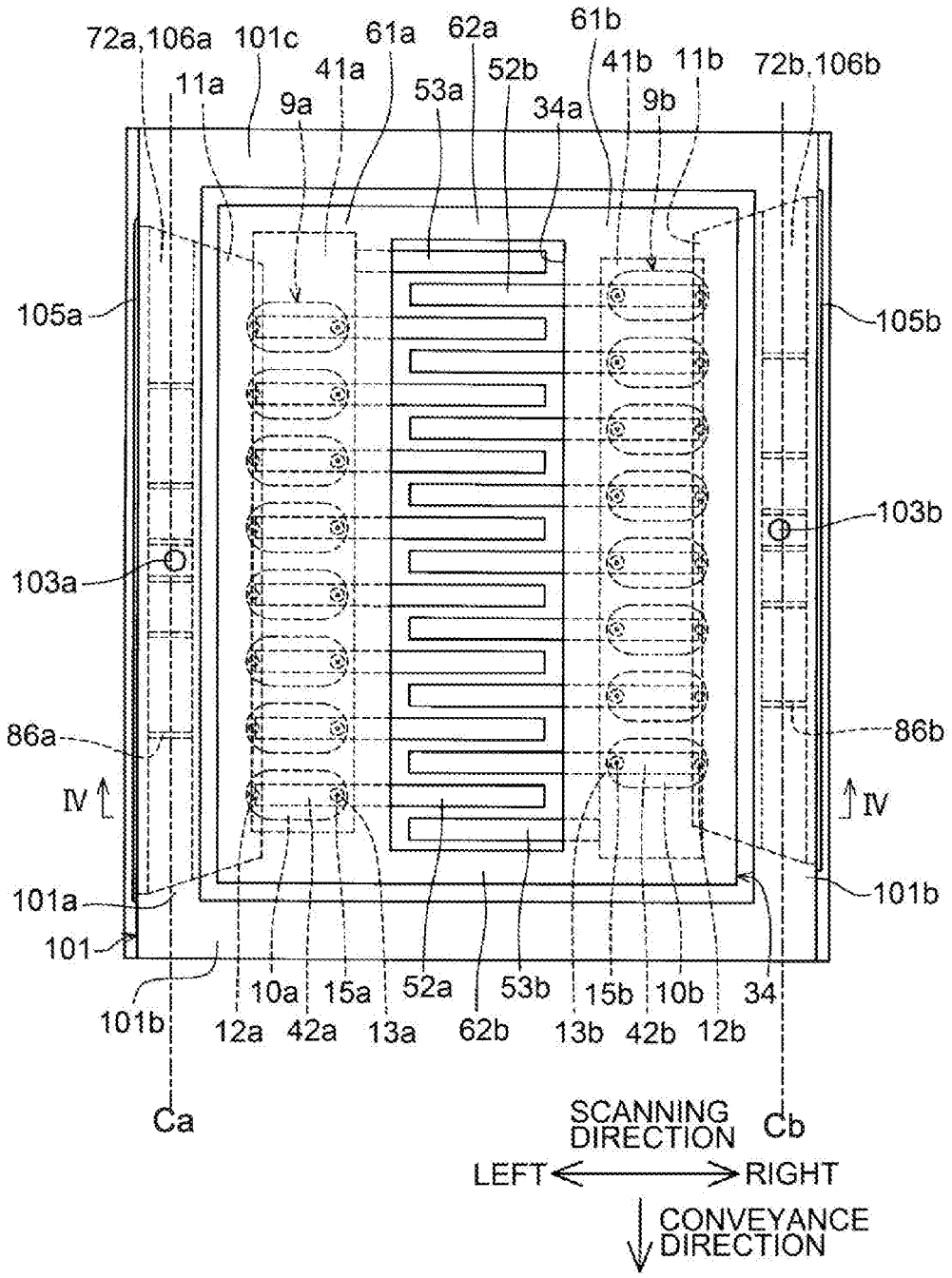
FIG. 4 is a plan view depicting an inkjet head in a first variation of the illustrative embodiment according to one or more aspects of the disclosure.
Figure 5:
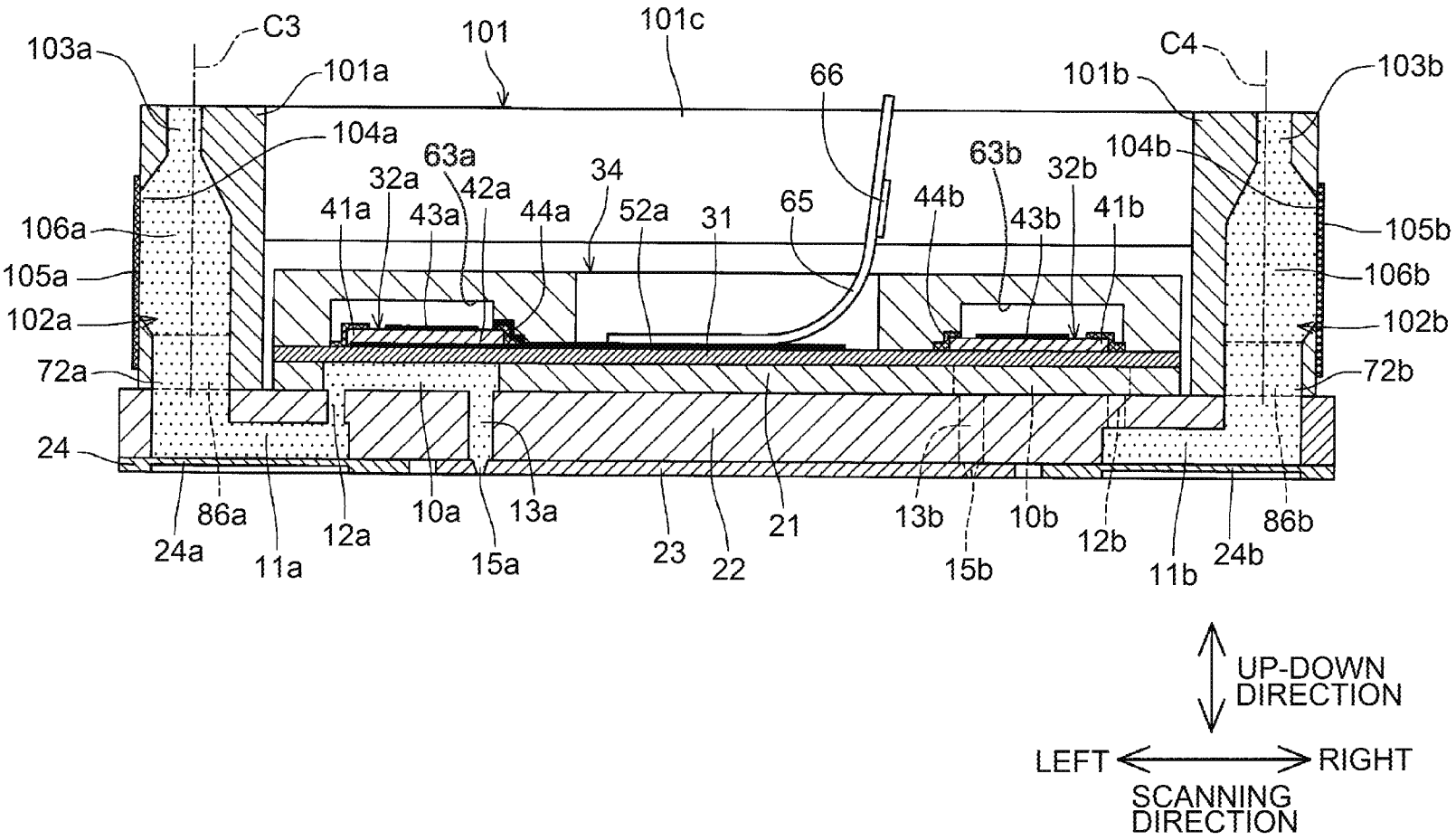
FIG. 5 is a sectional view taken along line IV-IV in FIG. 4 in the first variation of the illustrative embodiment according to one or more aspects of the disclosure.

As depicted in FIG. 4, the ink supply member 101 may have a frame-like shape. The entire portion of the support member 34 is located inside an opening defined by an inner circumference of the ink supply member 101. The ink supply member 101 includes a plurality of, for example, two, channel-defining portions 101*a* and 101*b*, and a plurality of, for example, two, connecting portions 101*c* and 101*d*. Each of the connecting portions 101*c* and 101*d* connect between ends of the channel-defining portions 101*a* and 101*b* in the conveyance direction. Each of the channel-defining portions 101 also changes a form of an ink flow channel similar to each of the ink supply members 35.

The ink supply member 101 has symmetry about a line extending along the conveyance direction through the center of the inkjet head 3 with respect to the scanning direction. Hereinafter, the left configuration of the ink supply member 101 in the scanning direction will be described.

The channel-defining portion 101*a* is disposed on a left end portion of the upper surface of the manifold plate 22 in the scanning direction. The channel-defining portion 101*a* includes a damper portion 102*a*, a communication channel 72*a*, and a supply channel 103*a* similar to the ink supply member 35*a*.

In the damper portion 102*a*, the opening 104*a* is defined in the left sidewall (i.e., the outer sidewall) of the damper portion 102*a* in the scanning direction. A damper film 105*a* is adhered to an exterior surface of the left sidewall of the damper portion 102*a* so as to close the opening 104*a*. The supply channel 103*a* is positioned to the left of a center line C3 of a damper chamber 106*a* (e.g., closer to the damper film 105*a* relative to the center line C3 of the damper chamber 106*a*).

The connecting portion 101*c* extends along the scanning direction and connects between the upstream ends of the channel-defining portions 101*a* and 101*b* in the conveyance direction. The connecting portion 101*d* extends along the scanning direction and connects the downstream ends of the channel-defining portions 101*a* and 101*b* in the conveyance direction.

In the illustrative embodiment, if a single ink supply member in which the ink supply members 35*a* and 35*b* are joined to each other is provided instead of providing the ink supply members 35*a* and 35*b* independently, it may be difficult to adhere the damper films 83*a* and 83*b* to the respective portions.

As opposed to this, in the first variation, the openings 104*a* and 104*b* are defined in the outer sidewalls of the damper portions 102*a* and 102*b*, respectively, in the scanning direction. Therefore, at the time of assembling the ink supply member 101, the damper films 105*a* and 105*b* may be adhered to the damper portions 102*a* and 102*b* from the outside simply and thus its operability may be high. The single ink supply member 101 includes two channel-defining portions 101*a* and 101*b*, whereby a parts count may be reduced.

In one example, even when the openings 104*a* and 104*b* are defined in the outer sidewalls of the damper portions 102*a* and 102*b*, respectively, in the scanning direction as described in the first variation, a member corresponding to the channel-defining portion 101*a* and another member corresponding to the channel-defining portion 101*b* may be provided independently.

In another example, even when the openings 82*a* and 82*b* are defined in the facing inner sidewalls of the damper portions 71*a* and 71*b*, respectively, in the scanning direction as described in the illustrative embodiment, a single ink supply member including portions corresponding to the ink supply members 35*a* and 35*b* may be adopted if it is possible to adhere the damper films 83*a* and 83*b* to the respective portions of the facing inner sidewalls of the damper portions 71*a* and 71*b*, respectively.

In the illustrative embodiment, the inner-wall surfaces of the damper chambers 81*a* and 81*b* opposite to the respective damper films 83*a* and 83*b* in the scanning direction are angled relative to the conveyance direction and the up-down direction. Nevertheless, in other embodiments, for example, the inner-wall surfaces of the damper chambers 81*a* and 81*b* may extend parallel to the conveyance direction and the up-down direction.

In the illustrative embodiment, the supply channels 73*a* and 73*b* are positioned closer to the respective damper films

83*a* and 83*b* relative to the center lines C1 and C2 of the damper chambers 81*a* and 81*b*, respectively.

Nevertheless, in other embodiments, for example, the supply channels 73*a* and 73*b* may be positioned such that center lines of the supply channels 73*a* and 73*b* coincide with the center lines C1 and C2 of the damper chambers 81*a* and 81*b*, respectively. In still other embodiments, the supply channels 73*a* and 73*b* may be positioned farther from the respective damper films 83*a* and 83*b* relative to the respective center lines C1 and C2.

In the illustrative embodiment, the lower ends of the supply channels 73*a* and 73*b* are located higher than the upper edges 82*a*2 of the openings 82*a* and 82*b*, respectively. Nevertheless, in other embodiments, for example, the lower ends of the supply channels 73*a* and 73*b* may be located at the same height as the upper edges 82*a*2 of the openings 82*a* and 82*b*, respectively.

In the illustrative embodiment, the edge portion 82*a*1 of the opening 82*a* and the edge portion 82*b*1 of the opening 82*b* are tapered such that each of the openings 82*a* and 82*b* has a cross-sectional area extending orthogonal to the scanning direction, which decreases with distance towards the outside from a corresponding one of the damper chambers 81*a* and 81*b*. Nevertheless, in other embodiments, for example, the edge portions 82*a*1 and 82*b*1 might not necessarily be tapered, but may extend parallel to the scanning direction.

Figure 6:
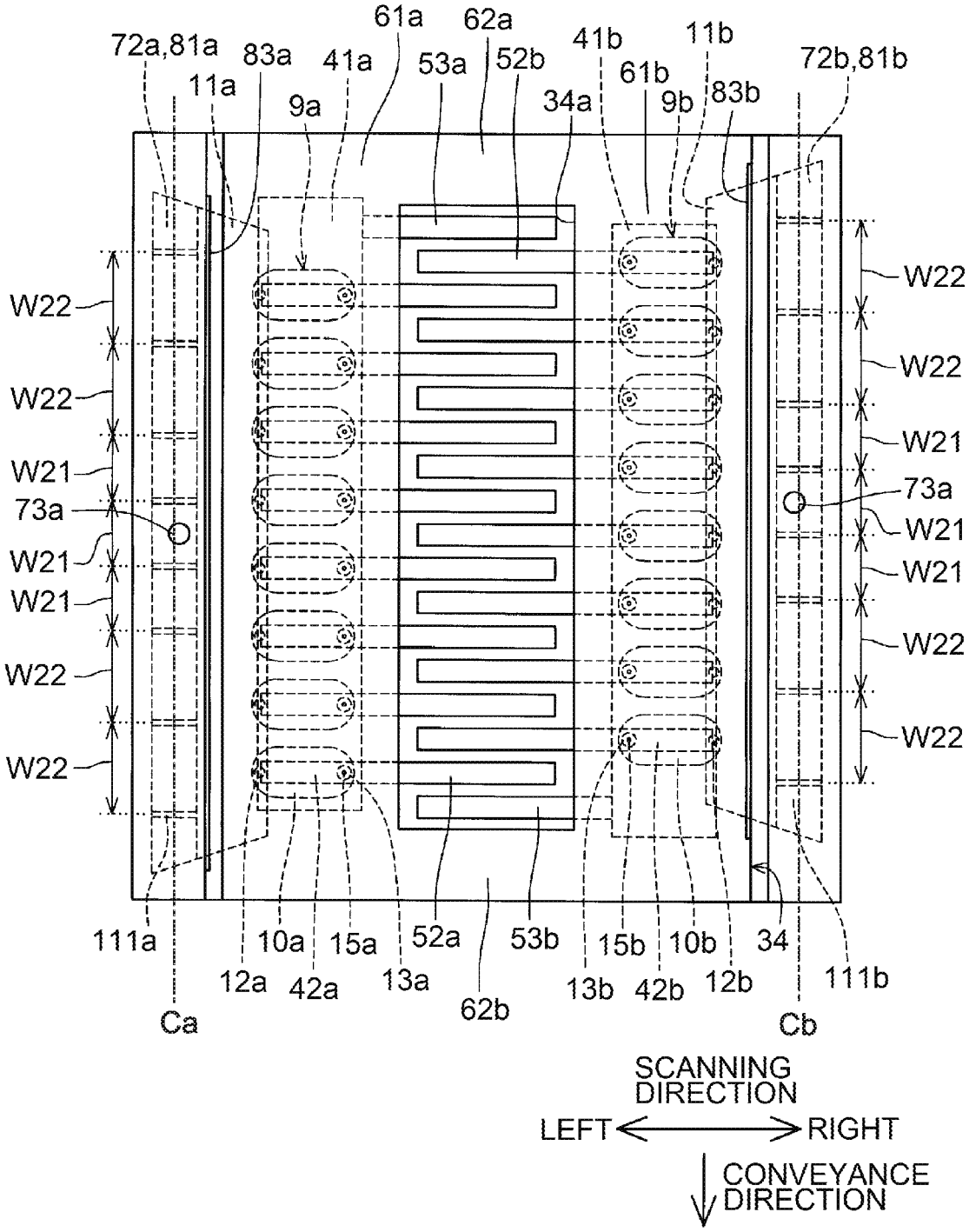
FIG. 6 is a plan view depicting an inkjet head in a second variation of the illustrative embodiment according to one or more aspects of the disclosure.

In the illustrative embodiment, the interval between each adjacent two of the flow-adjusting ribs 86*a* increases with distance from the central portion of the communication channel 72*a*, and the interval between each adjacent two of the flow-adjusting ribs 86*b* increases with distance from the central portion of the communication channel 72*b*. Nevertheless, the arrangement pattern of the flow-adjusting ribs 86*a* and 86*b* is not limited to the specific example. For example, in a second variation, as depicted in FIG. 6, a plurality of flow-adjusting ribs 111*a* are disposed in the communication channel 72*a* and a plurality of flow-adjusting ribs 111*b* are disposed in the communication channel and 72*b*. Some of the plurality of flow-adjusting ribs 111*a* and 111*b* disposed at a central portion of each of the communication channels 72*a* and 72*b* are equally spaced at a certain interval, which may be a first interval W21. The remainder of the plurality of flow-adjusting ribs 111*a* and 111*b* disposed at end portions of each of the communication channels 72*a* and 72*b* are equally spaced at another certain interval, which may be a second interval W22 greater than the first interval W21. In this case, also, ink may get harder to flow at the central portions of the communication channels 72*a* and 72*b* than the end portions of the communication channels 72*a* and 72*b* in the conveyance direction.

Figure 7:
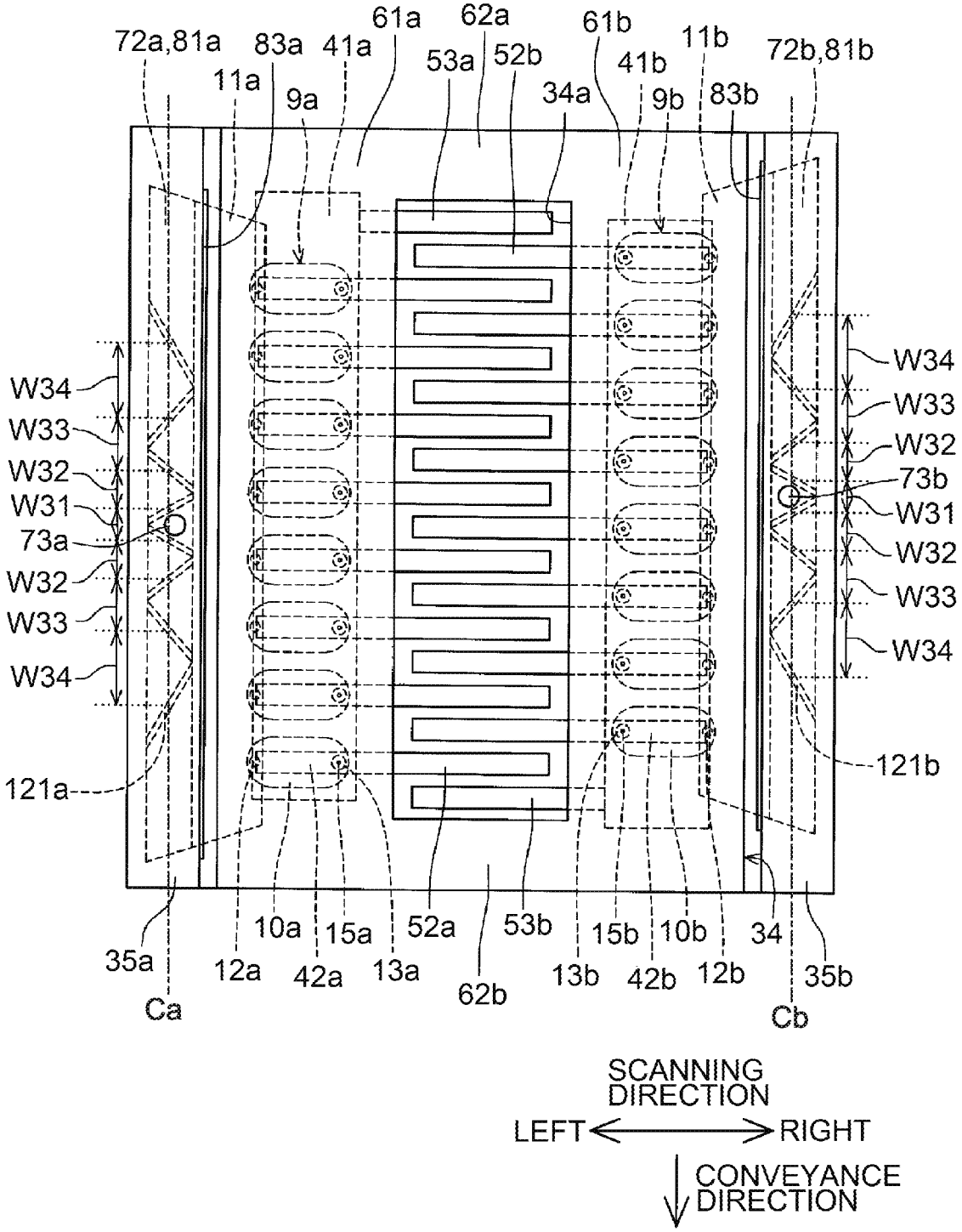
FIG. 7 is a plan view depicting an inkjet head in a third variation of the illustrative embodiment according to one or more aspects of the disclosure.

In the illustrative embodiment, the flow-adjusting ribs 86*a*, 86*b* extend parallel to the scanning direction. Nevertheless, the extending direction is not limited to the specific example. For example, in a third variation, as depicted in FIG. 7, a plurality of flow-adjusting ribs 121*a* are angled relative to the scanning direction in the communication channel 72*a*. Adjacent two of the flow-adjusting ribs 121*a* are angled towards respective directions opposite to each other with respect to the scanning direction. An inclination of the flow-adjusting ribs 121*a* relative to the scanning direction becomes greater with distance from the central portion of the communication channel 72*a*. Thus, an interval between centers of each adjacent two of the flow-adjusting ribs 121*a* in the scanning direction increases with distance from the central portion of the communication channel 72*a* in the conveyance direction (e.g., interval W31<interval W32<interval W33<interval W34 in FIG. 7). The interval between adjacent two of the flow-adjusting ribs 121*a* means an interval between centers of adjacent two of the flow-adjusting ribs 121*a* in the scanning direction. These centers of the flow-adjusting ribs 121*a* in the scanning direction intersect a center line Ca of the communication channel 72*a* in scanning direction. A plurality of flow-adjusting ribs 121*b* are disposed in the communication channel 72*b* in a similar manner to the plurality of flow-adjusting ribs 121*a*.

In the illustrative embodiment, the damper chambers 81*a* and 81*b* are connected with the respective communication channels 72*a* and 72*b* while the damper chambers 81*a* and 81*b* are located upstream of the communication channels 72*a* and 72*b*, respectively, in the ink flow direction. Nevertheless, in other embodiments, for example, ink channels, each of which might not include a wall including a damper film, may be connected with the respective communication channels 72*a* and 72*b*, respectively, while the ink channels are located upstream of the respective communication channels 72*a* and 72*b*.

In the illustrative embodiment, the inkjet head 3 includes two manifold channels 11*a* and 11*b* and two each of the damper portions 71, the communication channels 72, and the supply channels 73 corresponding to each of the manifold channels 11*a* and 11*b*. Nevertheless, in other embodiments, for example, an inkjet head may include a single manifold channel 11 and one each of the damper portion 71, the communication channel 72, and the supply channel 73 corresponding to the manifold channel. In still other embodiments, for example, an inkjet head may include three or more manifold channels 11 and three or more each of channel-defining members corresponding to the number of the manifold channels 11.

In the illustrative embodiment and variations, in the ink supply member 35, 101, the supply channel 73, 103 is positioned at the central portion of the damper chamber 81, 106 in the conveyance direction. Nevertheless, in other embodiments, for example, the supply channel 73, 103 may be positioned at one of the end portions of the damper chamber 81, 106 in the conveyance direction. The portion of the communication channel 72 overlapping the supply channel 73, 103 when viewed from above or below may allow larger amount of ink to flow than the other portion of the communication channel 72. In this case, also, in consideration of equal amount of ink supply, the interval between each adjacent two of the flow-adjusting ribs 86, 111, 121 may be reduced with distance from the overlapping portion.

In the illustrative embodiment and variations, the supply channel 73, 103 coincides with the communication channel 72 while the supply channel 73, 103 might not overlap any of the flow-adjusting ribs 86, 111, 121 when viewed from above or below. Nevertheless, in other embodiments, for example, the supply channel 73, 103 may overlap one or more of the flow-adjusting ribs 86, 111, 121 when viewed from above or below. Even when the ink flow still has a directivity in the up-down direction at the point of the communication channel 72, the flow-adjusting ribs 86, 111, 121 may disperse the directivity in the conveyance direction to make the liquid supply amount uniform in the conveyance direction.

In the illustrative embodiment and variations, in consideration of reachability of ink flow to the damper film 83, 105, the supply channel 73, 103 is positioned closer to the opening 82, 104 relative to the center line C of the damper chamber 83, 105. Nevertheless, in other embodiments, for example, the supply channel 73, 103 may be disposed such that, at the time the damper film 83, 105 deforms maximum, the supply channel 73, 103 overlaps the damper film 83, 105 when viewed from above or below. With this configuration, the damper film 83, 105 may act on ink flow directly and the damper film 83, 105 may further reduce pressure fluctuation.

The description has been made on the example in which the disclosure is applied to the inkjet head for ejecting ink from the nozzles. Nevertheless, in other embodiments, for example, the disclosure may be applied to other liquid ejection devices for ejecting ink from nozzles

What is claimed is:

1. A liquid ejection device comprising:

a first common liquid chamber and a second common liquid chamber, both the first common liquid chamber and the second common liquid chamber extend along a longitudinal direction;

a first liquid supply member defining a first liquid supply channel that is in communication with the first common liquid chamber via an outlet of the first liquid supply channel, the outlet of the first liquid supply channel extends along the longitudinal direction;

a second liquid supply member defining a second liquid supply channel that is in communication with the second common liquid chamber via an outlet of the second liquid supply channel, the outlet extends along the longitudinal direction; and wherein the first liquid supply member defines a first opening and includes a first damper film that covers the first opening;

the second liquid supply member defines a second opening and includes a second damper film that covers the second opening;

the first opening and the second opening face each other in a transverse direction, the transverse direction is orthogonal to the longitudinal direction.

2. The liquid ejection device according to claim 1, wherein the first liquid supply member includes a plurality of ribs located within the first liquid supply channel, the plurality of ribs are disposed side by side in the longitudinal direction.

3. The liquid ejection device according to claim 2, wherein the plurality of ribs includes a first rib, a second rib and a third rib;

the second rib is disposed in a first direction of the first rib, the first direction is in the longitudinal direction;

the third rib and an inlet of the first liquid supply channel are disposed in a second direction of the first rib, the second direction is in the longitudinal direction and opposite to first direction;

a distance from the first rib to the third rib in the longitudinal direction is smaller than a distance from the first rib to the second rib in the longitudinal direction.

* * * * *